United States Patent [19]

Stahlecker

[11] Patent Number: 5,010,624

[45] Date of Patent: Apr. 30, 1991

[54] SPINNING MACHINE HAVING SEVERAL SPINNING POINTS

[75] Inventor: Fritz Stahlecker, Bad Überkingen, Fed. Rep. of Germany

[73] Assignee: Hans Stahlecker, Fed. Rep. of Germany; a part interest

[21] Appl. No.: 446,694

[22] Filed: Dec. 6, 1989

[30] Foreign Application Priority Data

Dec. 9, 1988 [DE] Fed. Rep. of Germany ..... 3841544

[51] Int. Cl.[5] ..... D01H 5/74

[52] U.S. Cl. ..... 19/261; 19/258; 19/260; 19/293

[58] Field of Search ..... 19/258, 259, 260, 261, 19/293

[56] References Cited

U.S. PATENT DOCUMENTS

| | | | |
|---|---|---|---|
| 1,182,165 | 5/1916 | Goldsmith, Jr. | 19/261 |
| 1,912,946 | 6/1933 | Litty | 19/261 |
| 2,271,191 | 1/1942 | Gossett et al. | 19/261 |
| 2,357,982 | 9/1944 | Thomas et al. | 19/261 |
| 2,707,309 | 5/1955 | Wilson | 19/261 |
| 2,922,198 | 1/1960 | Barrett | 19/261 |
| 3,036,345 | 5/1962 | Naegeli | 19/261 |
| 3,371,389 | 3/1968 | Whitehurst | 19/259 |
| 4,373,233 | 2/1983 | Faure | 19/236 |
| 4,525,897 | 7/1985 | Schulz et al. | 19/260 |
| 4,561,152 | 12/1985 | Niimi et al. | 19/244 |
| 4,593,438 | 6/1986 | Barauke | 19/261 |
| 4,646,391 | 3/1987 | Wolf | 19/258 |

FOREIGN PATENT DOCUMENTS

| | | | |
|---|---|---|---|
| 3532555 | 3/1987 | Fed. Rep. of Germany | 19/261 |
| 59-15519 | 1/1984 | Japan . | |
| 62-69832 | 3/1987 | Japan . | |
| 2069832 | 3/1987 | Japan | 19/293 |
| 62-762029 | 7/1987 | Japan . | |
| 2162029 | 7/1987 | Japan | 19/293 |

*Primary Examiner*—Werner H. Schroeder
*Assistant Examiner*—Michael A. Neas
*Attorney, Agent, or Firm*—Evenson, Wands, Edwards, Lenahan & McKeown

[57] ABSTRACT

A spinning machine having several spinning points is disclosed having at least one drafting unit assigned to each spinning point. Each drafting unit has several top rollers and several drivable bottom rollers. At least the bottom rollers which are assigned to the feeding side for the fiber material are driven by a common drive shaft extending in longitudinal direction of the machine by means of transmission devices which contain a coupling. It is provided that at least the bottom rollers assigned to the feeding side are arranged adjustably for the adjusting of the distance with respect to the respective rollers which follow while maintaining a driving connection between the common drive shaft and the respective ones of said bottom rollers.

18 Claims, 7 Drawing Sheets

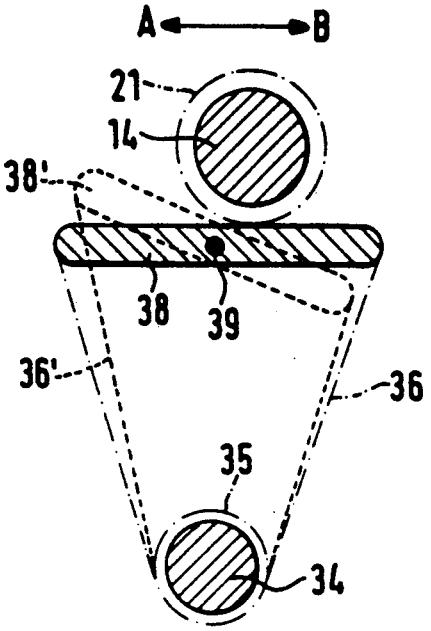
Fig. 5a
Fig. 5b
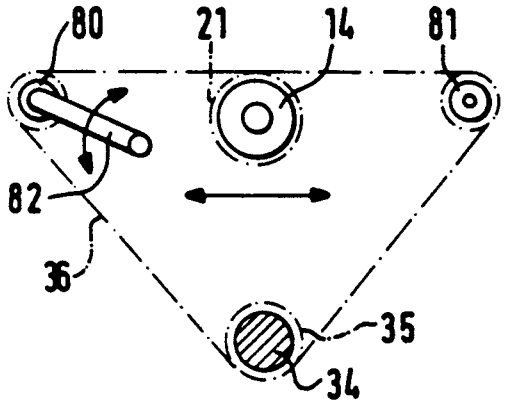
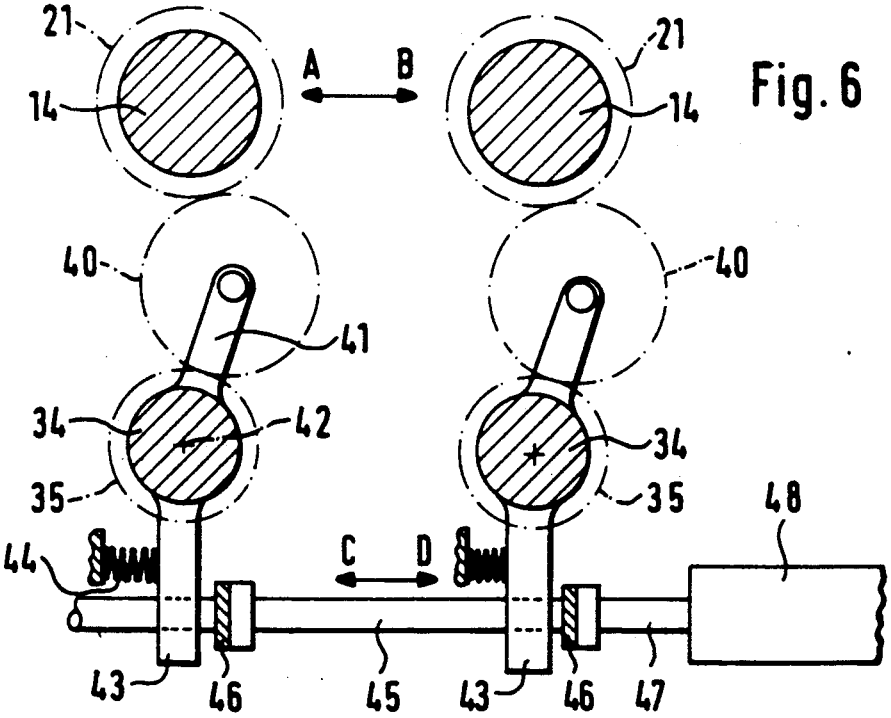
Fig. 6

Fig. 10
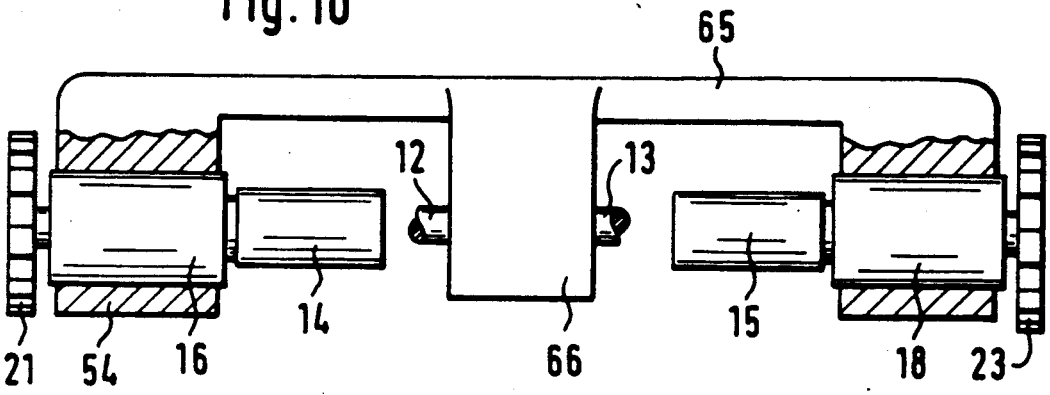
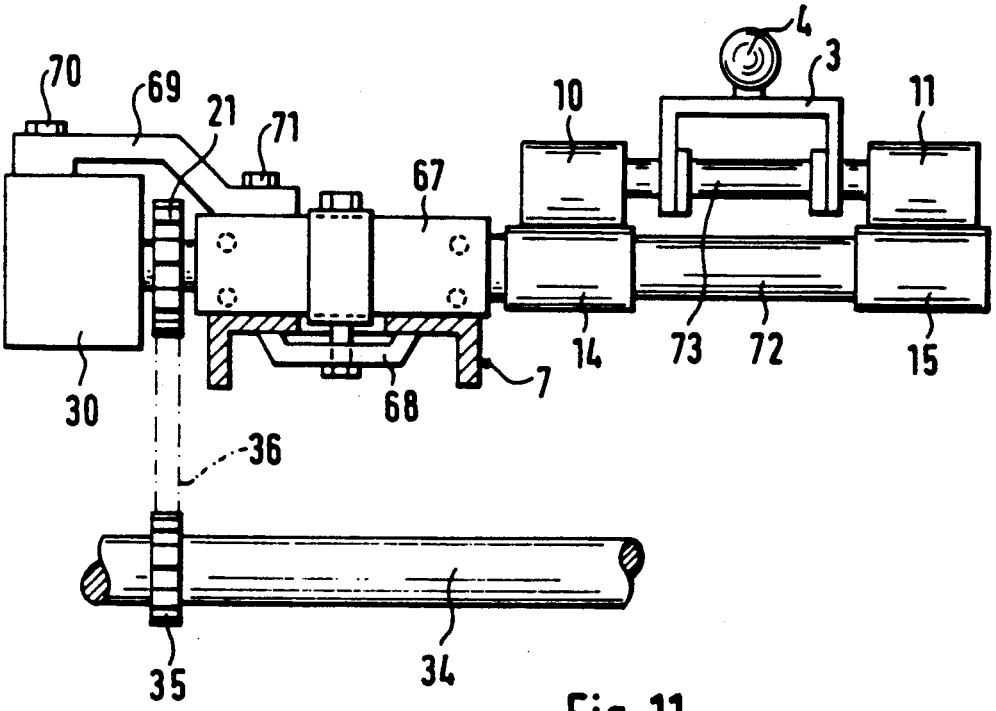
Fig. 11

SPINNING MACHINE HAVING SEVERAL SPINNING POINTS

BACKGROUND AND SUMMARY OF THE INVENTION

The invention relates to a spinning machine having several spinning points, at least one drafting unit being assigned to each of these spinning points and each drafting unit containing several top rollers and several drivable bottom rollers. At least the bottom rollers which are assigned to the feeding side for the fiber material are driven by a common drive shaft extending in longitudinal direction of the machine by means of transmission devices which contain a shiftable coupling.

Spinning machines having drafting units of the initially mentioned type are known (JP-A 59-15519, JP-A 62-69832, JP-A 62-162029). In these constructions, the bottom rollers of the respective drafting units are mounted in a common transmission case from which the bottom rollers project away, in an overmounted manner, toward one side or toward two opposite sides. The bottom rollers are driven by drive shafts which extend through in the longitudinal direction of the machine and are connected to the bottom rollers by means of wheel gears. A shifting coupling is also provided in these wheel gears. In the case of spinning machines of this type, it is possible to stop the drafting units of an individual spinning point; i.e., to switch off the drafting unit without, as a result, interfering with the drafting unit of the adjacent spinning points.

An object of the invention is to develop a spinning machine of the initially mentioned type in such a manner that a further improvement is obtained.

This object is achieved according to preferred embodiments of the invention in that at least the bottom rollers assigned to the feeding side are arranged adjustably for the purpose of adjusting the distance with respect to the respective following rollers.

By means of this construction, it is possible to adapt the drafting zone widths to the fiber material to be processed and thus optimize the drafting operation.

In a further development of the invention, it is provided that the transmission devices arranged between the drive shaft and the bottom rollers form a step-down gear. As a result, the circumstance is taken into account that, according to practical experiences, a drive shaft, which passes through in longitudinal direction of the machine, has better concentricity characteristics if it does not fall below a certain rotational speed. As a result, it becomes possible to provide the drive shaft with a sufficiently high rotational speed, and to nevertheless provide relatively low speeds for the bottom rollers, particularly on the feeding side.

In a further development of the invention, a shifting device is provided which actuates all couplings of the bottom rollers of a drafting unit together. As a result, it becomes possible to simultaneously stop all bottom rollers of a drafting unit, if they are driven individually, so that no additional breakage of the sliver or of the roving takes place within the drafting unit. This results in fewer problems for the start of a piecing in which fiber material must be fed again.

In a further development of the invention, toothed wheels are provided as transmission devices which are advantageously made of a plastic material. Toothed wheels of this type permit a precise maintaining of the rotational speed and thus a precise maintaining of the adjusted draft. However, they require no lubrication so that there is relatively little danger that the fiber material may become dirty.

In a further development of the invention, it is provided that an intermediate wheel is arranged between a toothed wheel of the drive shaft and a toothed wheel of the bottom roller. As a result, it becomes possible to implement a higher gearingdown. In a further development of this construction, it may be provided in this case that the intermediate wheel, by means of an adjusting device, can be disengaged from the toothed wheel of the bottom roller and/or from the toothed wheel of the drive shaft. This intermediate toothed wheel and the pertaining adjusting device may be utilized to function as a coupling by means of which the drive of the respective bottom roller may be connected or disconnected. A separate shiftable coupling will then not be necessary.

In a further development of the invention, it is provided that one toothed belt drive respectively is provided as the transmission device between the drive shaft and the bottom rollers. Synchronous belt drives of this type also permit a precise maintaining of rotational speeds without any limitations with respect to space. In a further development of this embodiment, it is provided that the toothed belt drive is equipped with devices for disengaging a toothed belt from a toothed wheel connected with the drive shaft or the bottom roller. As a result, it is also possible to interrupt the drive and switch it back on by the disengaging and engaging of the toothed belt so that a separate shifting coupling is not required.

In a further development of the invention, it is provided that, as the transmission devices for the same drafting unit, toothed wheels are provided between one or several bottom rollers and one or several drive shafts extending in longitudinal direction of the machine, and toothed belt drives are provided between one or several bottom rollers and a drive shaft. As a result, the circumstance is taken into account that the toothed wheels may possibly cause difficulties at high speeds. This type of a toothed belt drive may then be provided particularly for the bottom rollers on the delivery side.

In some applications, it may be sufficient, in the case of a yarn breakage, to stop only the bottom rollers of the feeding side and perhaps also the bottom roller or the two bottom rollers which are next in moving direction of the sliver. It will then be possible to provide, particularly for the bottom rollers of the delivery side, no possibility for an individual stopping. In this case, these bottom rollers of the delivery side may then be constructed as shaft which extend through in the longitudinal direction of the machine, as customary today in drafting units for all bottom rollers.

Other objects, advantages and novel features of the present invention will become apparent from the following detailed description of the invention when considered in conjunction with the accompanying drawings.

BRIEF DESCRIPTION OF THE DRAWINGS

FIGS. 5*a* to 5*b* schematically depict other embodiments of a belt drive constructed according to the invention;

FIG. 6 is a representation of toothed wheel drives having an adjustable intermediate wheel, constructed according to a preferred embodiment of the invention;

FIG. 10 is a schematic representation of two bottom rollers of adjacent drafting unit which are arranged in a common adjustable element, according to another preferred embodiment of the invention; and FIG. 11 is a schematic view of a drive for a bottom roller twin which is overmounted and is driven by a drive shaft passing through in longitudinal direction of the machine, constructed according to a preferred embodiment of the invention.

DETAILED DESCRIPTION OF THE DRAWINGS

Figure 1:
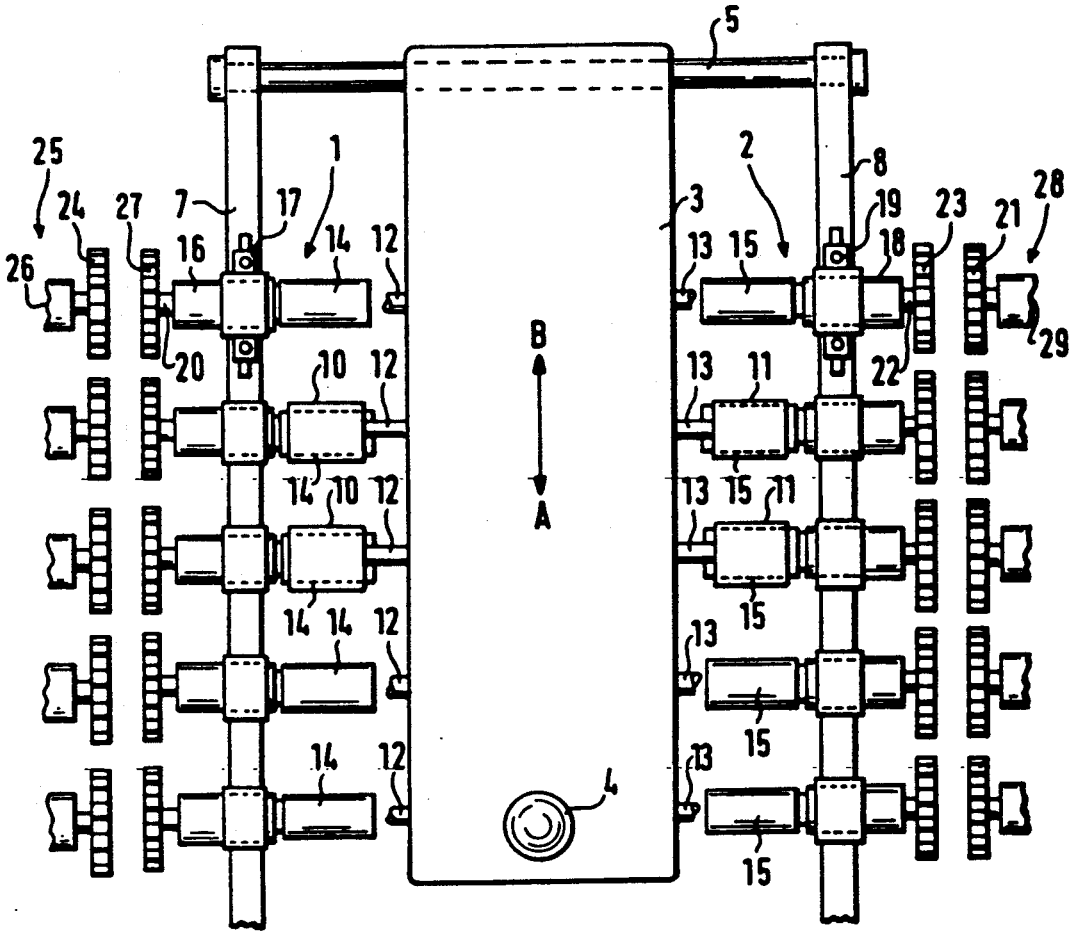
FIG. 1 is a schematic view of several drafting units of a spinning machine, constructed according to a preferred embodiment of the invention.

FIG. 1 shows two adjacent drafting units 1, 2 of a spinning machine which has a plurality of spinning points and a corresponding plurality of drafting units. The two adjacent drafting units 1, 2 have a special relationship to one another in that a common load carrier 3 is assigned to them which is adjustable by means of a grip 4. Drafting units 25, 28, which connect to both sides, are only outlined.

The drafting units 1, 2 are constructed as so-called five-cylinder drafting units which normally are also equipped with apron guides which, however, are not shown here. Drafting unit 1 contains five bottom rollers 14, while drafting unit 2 correspondingly has five bottom rollers 15. In the load carrier 3 which can be swivelled around a rod 5 held in roller stands 7, 8, top rollers 10, 11 are assigned to these bottom rollers 14, 15. The shafts 12, 13 of these top rollers 10, 11, which may be constructed in one piece, are disposed in the load carrier 3. In the case of the embodiment according to FIG. 1, only two top rollers 10, 11 respectively are shown. It should be understood that top rollers 10, 11 are assigned to each bottom roller 14, 15.

The bottom rollers 14, 15 are each disposed in bearing housings 16, 18 which are held at the roller stands 7, 8. The shafts 20, 22 disposed in the bearing housings 16, 18, at their end which is opposite the bottom rollers 14, 15, are each non-rotatably equipped with toothed wheels 21, 23. These toothed wheels 21, 23 as well as the toothed wheels 24, 27 of the shafts of the bottom rollers of the adjacent drafting units 25, 28, which are disposed in bearing housings 26, 29, are driven by individual drives which are derived from drive shafts extending through in the longitudinal direction of the machine and which may each be interrupted by means of a shiftable coupling. These drives will later be explained in detail. Separate drive shafts extending through in the longitudinal direction of the machine are, as a rule, assigned to the bottom rollers 14, 15 of the drafting units 1, 2 which follow one another in passage direction of the fiber material (arrow A). As a result, it is possible to adjust the desired speed differences at the central transmission of the machine. The toothed wheels 21, 23, 24, 27 may then essentially have an identical construction for all bottom rollers 14, 15. However, it is also contemplated to derive the drive of two bottom rollers, which follow one another in fiber material passage direction, from a common drive shaft extending through in the longitudinal direction of the machine and then implement the different speeds by means of a corresponding dimensioning of the gearing devices.

As also shown in FIG. 1, in the preferred construction, the toothed wheels 21, 23, 24, 27 of the bottom rollers 14, 15 of, in each case, one drafting unit 1, 2, 25, 28 are aligned behind one another in passage direction of the fiber material. As a result, relatively little space is required in the longitudinal direction of the machine; i.e., the machine sections are small. Particularly when varying gearings are adjusted by means of differently dimensioned toothed wheels 21, 23, 24, 27, it is also possible to offset the toothed wheels 21, 23, 24, 27, which are each part of one of the drafting units 1, 2, 25, 28, with respect to one another in the longitudinal direction of the machine.

In order to be able to adjust the spans between the bottom rollers 14, 15 and the pertaining top rollers 10, 11 of, in each case, one drafting unit 1, 2, 25, 28, at least the bottom rollers 14, 15, which are situated on the feeding side, are mounted at the roller stands 7, 8 so that they can be adjusted in and against the passage direction of the fiber material (direction of arrows A, B). For this purpose, holding devices 17, 19 are provided which may be adjusted correspondingly. Naturally, a corresponding adjustment of the top rollers 10, 11 into the load carrier 3 is connected with an adjustment of the bottom rollers 14, 15. The adjusting possibilities are constructed to be such that the driving connection to the pertaining drive shaft extending through in the longitudinal direction of the machine is maintained. As will be explained in the following, the adjustment takes place as a function of the chosen transmission devices linearly with respect to the drive shaft or concentrically with respect to the drive shaft.

Figure 2:
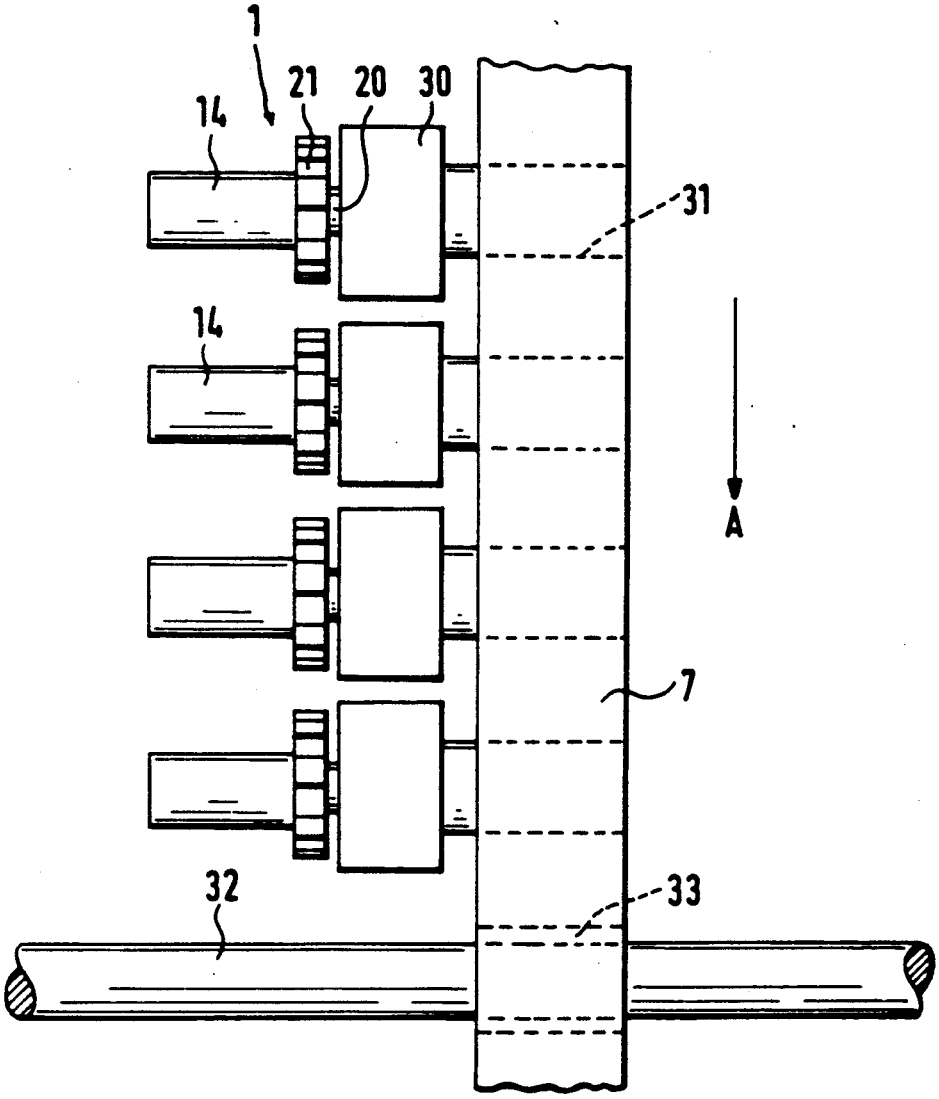
FIG. 2 is a view similar to FIG. 1 depicting a modified embodiment of the invention.

In the embodiment according to FIG. 2, the bottom rollers 14, together with their toothed wheels 21 and the shafts 20 as well as with a shiftable coupling 30, are overmounted in roller stands 7 on one side with respect to this roller stand 7. The shiftable couplings 30, by means of which the drive to the pertaining drive shaft can be interrupted, are held at the roller stand 7 by means of extensions 31. In this case, at least the bottom rollers assigned to the feeding side (together with the top roller which is not shown) can be adjusted in the direction of the passage of the fiber material (direction of arrow A).

In the embodiment according to FIG. 2, it is also provided that only the four bottom rollers 14 which are first in passage direction (A) of the fiber material are equipped with individually interruptable drives which are derived from the passing-through drive shafts. The bottom roller 32 which is located on the delivery side, on the other hand, is constructed as a drive shaft extending through in the longitudinal direction of the machine; i.e., as a so-called bottom cylinder. Since, as a rule, an apron guide is provided in the zone in front of this bottom delivery roller 32, it may be provided that this bottom delivery roller 32, in the case of a yarn breakage or the like, is not stopped but continues to run.

Figure 3:
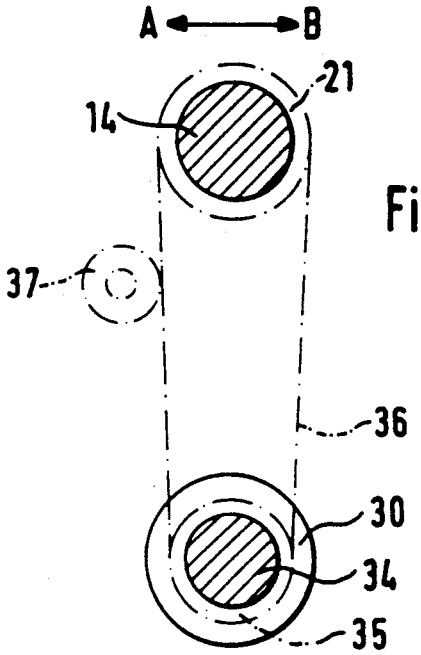
FIG. 3 is a schematic representation of a toothed belt drive between a drive shaft and an individual bottom roller, constructed according to a preferred embodiment of the invention.

FIG. 3 is a schematic representation of a toothed belt drive which is suitable for driving the bottom rollers 14, 15 of the embodiments according to FIG. 1 and 2. A drive shaft 34, which extends through in the longitudinal direction of the machine, is assigned to the bottom roller 14 and is arranged at a moderate distance from the bottom roller 14. The drive shaft 34 is equipped with a toothed wheel 35 which, by means of a toothed belt 36, drives the toothed wheel 21 of the bottom roller 14. The toothed wheel 35 is connected with the drive shaft 34 by means of a shift coupling 30 so that the drive between the drive shaft 34 and the toothed wheel 35 may be interrupted. In a manner not shown in detail, the bottom roller 14 can be linearly adjusted in the direction of the arrows (A, B), i.e., in the plane of the drafting zone. In order to carry out a compensation of lengths, an elastically loaded tension roller 37 is assigned to the toothed belt 36.

As also shown in FIG. 3, a gearing-down is provided between the drive shaft 34 and the bottom roller 14; i.e., toothed wheel 35 is smaller than toothed wheel 21. As a result, it is possible, despite the low speed of the bottom roller 14, to let the drive shaft 34 run at a correspondingly higher rotational speed which is advantageous for a concentricity of the drive shaft 34 extending through in the longitudinal direction of the machine.

Figure 4:
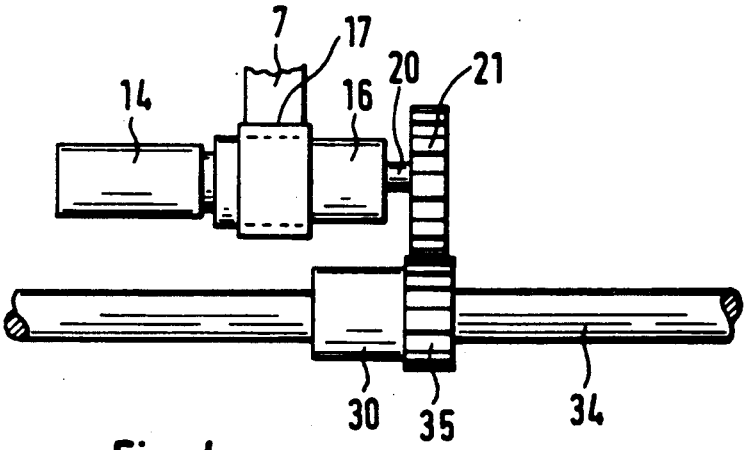
FIG. 4 is a schematic representation of a toothed wheel drive between an individual bottom roller and a drive shaft which extends through past a plurality of drafting units constructed according to preferred embodiments of the invention.

FIG. 4 shows a toothed wheel drive for bottom rollers 14, as it can be used for the embodiment according to FIG. 1 and also, analogously, for the embodiment according to FIG. 2. A toothed wheel 35 is arranged on a drive shaft 34 extending through in the longitudinal direction of the machine by means of a shiftable coupling 30. This toothed wheel 35 mates with a toothed wheel 21 which is arranged on the shaft of the bottom roller 14. Also in this embodiment, it is provided that a gearing-down is provided between the shaft 34 and the bottom roller 14; i.e., toothed wheel 35 is smaller than toothed wheel 21. Thus, it is possible also in this embodiment to let the shaft 34 run at a relatively higher rotational speed although the bottom roller 14 rotates at a relatively low rotational speed. This gearing-down is important particularly for the bottom rollers 14, 15 of the feeding side.

In order to permit an adjusting of the spans also in the case of an embodiment according to FIG. 4, it is advantageous for the holders 17 to be guided in or on the roller stands 7 in such a manner that they are concentrically adjustable with respect to the drive shaft 34.

FIG. 5*a* shows another embodiment of a drive which permits a linear adjustment in the direction of the arrows (A, B) of the bottom roller 14. The belt 36, which loops around the wheel 35 of the drive shaft 34, is guided around a deflecting guide 38 which can be swivelled around a shaft 39 which is parallel to the bottom roller 14. The deflecting guide 38 guides the belt 36 tangentially with respect to the wheel 21 of the bottom roller and parallel to the adjusting direction (A, B). By means of the swivelling of the deflecting guide 38, which may take place by means of a not shown adjusting element, which is controlled by a yarn breakage sensor, the belt may also be disengaged from the wheel 21 so that the deflecting guide 38, at the same time, takes over the function of a shifting coupling. A separate shifting coupling is therefore not required. A chain may be provided instead of a belt.

FIG. 5*b* shows an embodiment which, in principle, is similar to the embodiment according to FIG. 5*a*. In the embodiment according to FIG. 5*b*, a toothed belt 36 is looped around a toothed wheel 35 arranged on the shaft 34 and a toothed wheel 21 which is firmly connected with the bottom roller 14. The toothed belt 36 is guided by means of two deflecting wheels 80, 81 approximately tangentially with respect to the toothed wheel 21. Therefore, the bottom roller 14 is linearly adjustable without any change of the drive. At least the deflecting wheel 80 is arranged on a swivel arm 82 which can be swivelled in such a manner that the toothed belt 36 can be lifted off the toothed wheel 21. A separate coupling is therefore also not required in this embodiment.

FIG. 6 shows another embodiment for a toothed wheel drive of the bottom rollers 14. The drive shafts 34, which extends through in the longitudinal direction of the machine, are each equipped with toothed wheels 35 which mate with intermediate wheels 40 which, in turn, mate with the toothed wheel 21 of the pertaining bottom roller 14. The intermediate wheels 40 are arranged on swivelling levers 41 which swivel around the shaft 42 of the drive shaft 34. They are extended by means of an arm 43 to which an adjusting device is assigned by means of which the intermediate wheels 40 of a drafting unit can jointly be swivelled out of the operating position and back into the operating position. The intermediate wheels 40 are also used as a shifting coupling. By means of thrust pieces 46, the piston 47 or an extension in the form of a pressure rod 45 of a pneumatic press 48 is applied to the arms 43. Against the effect of pressure springs 44, the arms 43 can be disengaged from the toothed wheel 21 of the bottom roller 14. In this embodiment, it is possible to linearly adjust the bottom rollers 14 in the direction of the arrows (A, B) over a short area. If larger adjusting areas are desired, it is also advantageous in this case to provide a guide for the holding devices of the bottom rollers 14 which is concentric with respect to the shaft 42 of the drive shafts 34.

Figure 7:
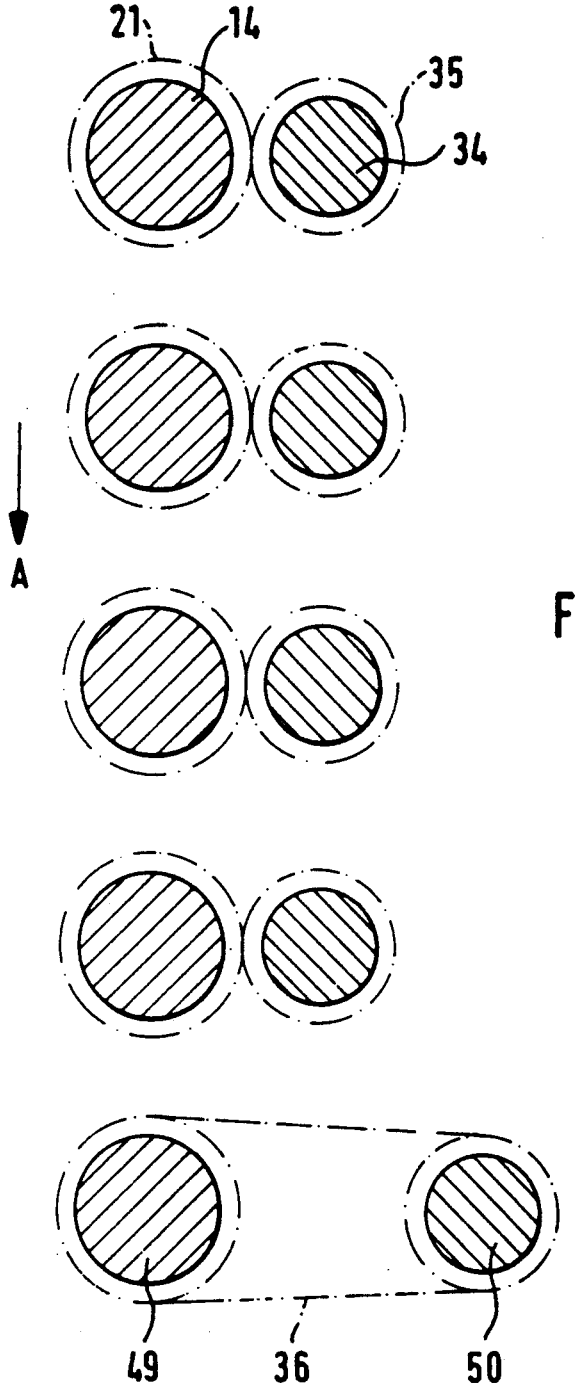
FIG. 7 is a sectional schematic view of a drafting unit in a mixed construction; i.e., with a toothed wheel drive and a toothed belt drive, constructed according to a preferred embodiment of the invention.

FIG. 7 is a schematic representation of a five-cylinder drafting unit, in which apron guides are not shown. The four bottom rollers 14, which are first in passage direction (A) of the fiber material, are driven by drive shafts 34 extending through in the longitudinal direction of the machine corresponding to the embodiment according to FIG. 4. As in a modification of the embodiment according to FIG. 4, it may be provided in this embodiment that a shifting coupling is arranged between the toothed wheel 21 and the pertaining bottom roller 14. This type of an arrangement of the shifting coupling has the advantage that, if required, it can more easily be removed and exchanged than in a case where it is arranged on the continuous drive shaft 34 which is composed of segments. The bottom roller 49, which is situated at the delivery side and which, as a rule, rotates at a relatively high rotational speed, is driven by means of its own drive shaft 50 by means of a toothed belt 36. This drive shaft 50 is spaced farther away from the bottom roller 49. The drive shaft 50 and the bottom roller 49 are equipped with toothed wheels around which a toothed belt 36 is looped. This mixed construction, i.e., the simultaneous use of toothed wheel transmissions and toothed belt drives in a drafting unit may have advantages for reasons of space but also for constructional reasons, particularly in the case of high speeds at which toothed plastic wheels may no longer be suitable under certain circumstances. Also in the embodiment according to FIG. 7, it is not necessary that the bottom roller 49 located on the delivery side can be stopped individually.

In particular, when the shiftable coupling is not assigned to the bottom roller 14, it is possible to connect the bottom roller 14 directly with the toothed wheel 21 and to dispose it on an axle 20'; i.e., not by means of a shaft.

Figure 8:
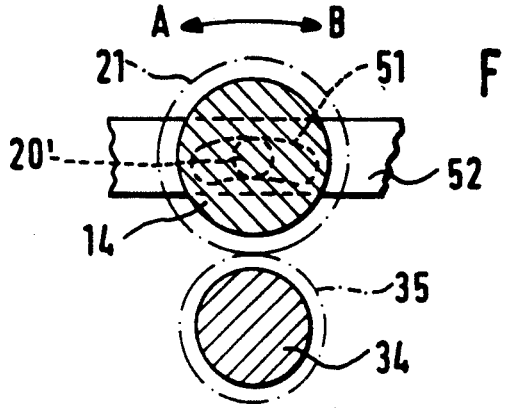
FIG. 8 is a schematic view of a cutout of a drafting unit with an adjusting guide for a bottom roller, constructed according to a preferred embodiment of the invention.

As shown in FIG. 8, it is possible in this case to guide the axle 20' in a slotted guide 51 of a component 52, for example, of a roller stand, this slotted guide 51 being concentric with respect to the drive shaft 34, and to fix this axle 20' in the respective desired position by means of fastening elements which are not shown. The engaging conditions between the toothed wheel 35, the drive shaft 34 and the toothed wheel 21 of the bottom roller 14 are therefore not changed in the case of an adjusting in the direction of the arrows (A, B).

Figure 9:
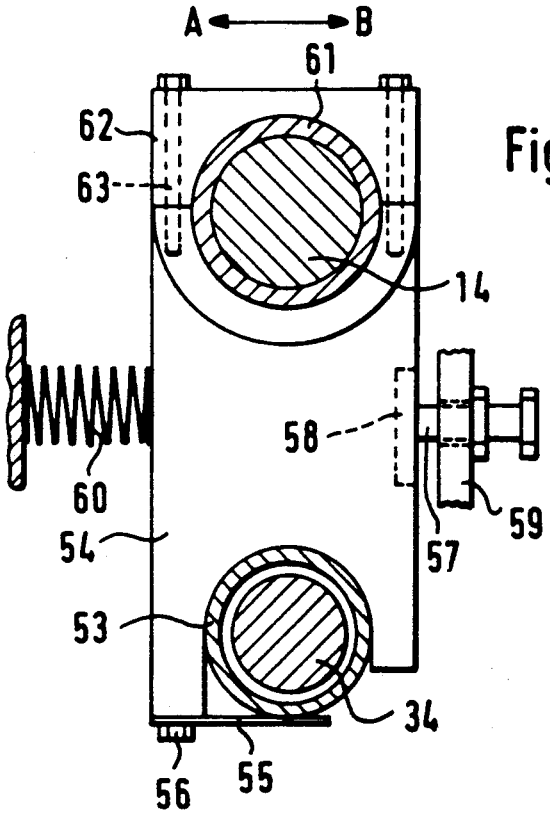
FIG. 9 is a schematic view of another embodiment of an adjusting guide for a bottom roller.

In the embodiment according to FIG. 9, the bottom roller 14, which is driven by a drive shaft 34 extending through in the longitudinal direction of the machine, is not disposed in a stationary roller stand, but in a rocker 54 which can be swivelled concentrically around the drive shaft 34. Toothed wheels or toothed belt drives may be provided as transmission devices for transmitting the drive from the drive shaft 34 to the bottom roller 14. The drive shaft 34 is surrounded by a concentric tube 53 onto which the rocker 54 is clamped by means of a leaf spring holder 55 which is held at the rocker 54 by means of a screw 56. The rocker 54 receives a slide bearing 61 for the bottom roller 14 which is held in a prismatic guide by means of a clamping piece 62 which is fastened by screws 63. The adjusting of the rocker 54 takes place by means of an adjusting screw 57 which is screwed into a stationary component 59 and which supports itself against a wear-resistant pressure element 58 of the rocker 54. By means of a pressure spring 60, the rocker 54 is held in the operating position at the adjusting screw 57. In a modified embodiment, another adjusting screw or a fastening screw is provided instead of a pressure spring, this screw being applied after the adjusting of the position of the rocker 54 and then fixing the rocker 54 in the adjusted position.

As shown in FIG. 10 in a further development, the rockers 54 of two adjacent drafting units are connected with one another by means of a yoke 65 so that they can be adjusted only jointly. The top rollers, which are assigned to the bottom rollers 14, 15, by means of their shafts 12, 13, may also be held at the rocker 54 or at the yoke 65. For this purpose, the yoke 65 is provided with a corresponding projection 66. In this case, it is ensured that the top rollers 10, 11 are also adjusted correctly when the bottom rollers 14 15 are adjusted,.

FIG. 11 shows an embodiment in which the bottom rollers 14, 15 of two adjacent drafting units are combined to a bottom roller twin which is overmounted on a roller stand 7. The bottom rollers 14, 15 are constructed in one piece and are jointly disposed in a relatively wide bearing housing 67 which is fixed on a roller stand 7 by means of a clamping holder 68. On the side of the bearing housing 67, which faces away from the bottom rollers 14, 15, a toothed wheel 21 and a shiftable coupling 30 are arranged. The latter is held by means of a bracket 69 which, by means of screws 70 and 71, is held at the coupling or the bearing housing 67 or the holding bracket 68.

The bottom rollers 14, 15, which are constructed as bottom roller twins, are driven by a drive shaft 34 extending through in the longitudinal direction of the machine on which a toothed wheel 35 is arranged which drives the toothed wheel 21 by means of a toothed belt 36.

So-called top roller twins, i.e., top rollers 10, 11 which are arranged on a common axle 73, are assigned to the bottom rollers 14, 15 and are held in a common load carrier 3.

The embodiment according to FIG. 11 is particularly suitable for machines in which yarn components pass through at, in each case, two adjacent drafting units, are guided together in the same machine into a double yarn and are wound up as a double yarn. In this case, when one yarn component breaks, the feeding of fiber material is interrupted in both drafting units. It is therefore useful to construct the two bottom rollers 14, 15 as a unit in this case and correspondingly stop them and restart them simultaneously.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A drafting arrangement for a spinning machine having several spinning points, at least one drafting unit being assigned to each of these spinning points and each drafting unit containing several top rollers and several drivable bottom rollers, and at least the bottom rollers assigned to a feeding side for fiber material being driven by a common drive shaft extending in a longitudinal direction of the machine by means of transmission devices containing a shiftable coupling for selectively engaging and disengaging a driving connection between the common drive shaft and respective ones of said bottom rollers, wherein at least the bottom rollers assigned to the feeding side are arranged adjustably for accommodating the adjusting of their position with respect to the respective rollers which follow while maintaining a driving connection between the common drive shaft and the respective ones of said bottom rollers.

2. A drafting arrangement according to claim 1, wherein the bottom rollers can be adjusted by means of a guide extending concentrically with respect to an axis of the drive shaft.

3. A drafting arrangement according to claim 1, wherein the bottom rollers can be adjusted essentially in parallel to a tangent of the drive shaft.

4. A drafting arrangement according to claim 1, wherein the bottom rollers assigned to a drive shaft are each disposed in a holding device capable of being swivelled concentrically with respect to the drive shaft.

5. A drafting arrangement according to claim 1, wherein separate drive shafts extending in the longitudinal direction of the machine are provided for the bottom rollers arranged successively in the drafting units.

6. A drafting arrangement according to claim 1, wherein the transmission devices arranged between the drive shaft and the bottom rollers form a gearing-down transmission.

7. A drafting arrangement according to claim 1, wherein a shifting device is provided which together actuates the coupling of the bottom roller of a drafting unit.

8. A drafting arrangement according to claim 1, wherein toothed wheels are provided as the transmission devices.

9. A drafting arrangement according to claim 8, wherein the toothed wheels are made of plastic.

10. A drafting arrangement according to claim 8, wherein a toothed wheel is arranged on the drive shaft for each bottom roller and drives a toothed wheel connected with one bottom roller respectively.

11. A drafting arrangement according to claim 8, wherein a coupling operates between the bottom roller and its toothed wheel.

12. A drafting arrangement according to claim 8, wherein an intermediate wheel is arranged between the toothed wheel of the drive shaft and the toothed wheel of the bottom roller.

13. A drafting arrangement according to claim 12, wherein the intermediate wheel, by means of an adjusting device, can be disengaged from one of the toothed wheels of the bottom rollers and the toothed wheel of the drive shaft.

14. A drafting arrangement according to claim 1, wherein one toothed belt drive respectively is provided as the transmission device between the drive shaft and the bottom rollers.

15. A drafting arrangement according to claim 14, wherein the toothed belt drive is equipped with devices for detaching a toothed belt from a toothed wheel connected with one of the drive shafts and a bottom roller.

16. A drafting arrangement according to claim 1, wherein, for the same drafting unit, toothed wheels are provided as transmission devices between at least one bottom roller and drive shafts extending in the longitudinal direction of the machine, and wherein toothed belt drives are provided as transmission devices between said at least one bottom roller and the drive shafts.

17. A drafting arrangement for a spinning machine having several spinning points, at least one drafting unit being assigned to each of these spinning points and each drafting unit containing several top rollers and several drivable bottom rollers, and at least the bottom rollers assigned to a feeding side for fiber material being driven by a common drive shaft extending in a longitudinal direction of the machine by means of transmission devices containing a shiftable coupling, wherein at least one bottom rollers assigned to the feeding side are arranged adjustably for accommodating the adjusting of their position with respect to the respective rollers which follow, wherein toothed wheels are provided as the transmission devices, wherein an intermediate wheel is arranged between the toothed wheel of the drive shaft and the toothed wheel of the bottom roller, and wherein the intermediate wheel, by means of an adjusting device, can be disengaged from one of the toothed wheel of the bottom roller and the toothed wheel of the drive shaft.

18. A drafting arrangement for a spinning machine having several spinning points, at least one drafting unit being assigned to each of these spinning points and each drafting unit containing several top rollers and several drivable bottom rollers, and at least the bottom rollers assigned to a feeding side for fiber material being driven by a common drive shaft extending in longitudinal direction of the machine by means of transmission devices containing a shiftable coupling, wherein at least the bottom rollers assigned to the feeding side are arranged adjustably for accommodating the adjusting of their position with respect to the respective rollers which follow, wherein one toothed belt drive respectively is provided as the transmission device between the drive respectively is provided as the transmission device between the drive shaft and the bottom rollers, and wherein the toothed belt drive is equipped with devices for detaching a toothed belt from a toothed wheel connected with one of the drive shaft and the bottom roller.

* * * * *